US007537091B2

(12) United States Patent
Fargo

(10) Patent No.: US 7,537,091 B2
(45) Date of Patent: May 26, 2009

(54) MAGNETIC ELEVATOR DOOR MOVER

(75) Inventor: Richard N. Fargo, Plainville, CT (US)

(73) Assignee: Otis Elevator Company, Farmington, CT (US)

( * ) Notice: Subject to any disclaimer, the term of this patent is extended or adjusted under 35 U.S.C. 154(b) by 588 days.

(21) Appl. No.: 10/577,985

(22) PCT Filed: Nov. 17, 2003

(86) PCT No.: PCT/US03/36754

§ 371 (c)(1),
(2), (4) Date: May 2, 2006

(87) PCT Pub. No.: WO2005/058738

PCT Pub. Date: Jun. 30, 2005

(65) Prior Publication Data

US 2007/0119659 A1 May 31, 2007

(51) Int. Cl.
*B66B 13/14* (2006.01)

(52) U.S. Cl. ..... 187/316; 187/313; 187/315; 187/320; 187/330; 187/336; 310/12; 310/13; 318/135; 318/687

(58) Field of Classification Search ..... 187/313, 187/316, 320, 330, 336, 315; 310/12, 13; 318/135, 687

See application file for complete search history.

(56) References Cited

U.S. PATENT DOCUMENTS

| | | | | |
|---|---|---|---|---|
| 3,533,188 | A * | 10/1970 | Griffith et al. | 49/360 |
| 4,410,067 | A | 10/1983 | Leiner et al. | |
| 4,674,231 | A * | 6/1987 | Radek et al. | 49/118 |
| 4,876,765 | A * | 10/1989 | Karita | 16/102 |
| 5,134,324 | A * | 7/1992 | Sakagami et al. | 310/12 |
| 5,862,887 | A * | 1/1999 | Swaybill et al. | 187/313 |
| 6,543,581 | B1 * | 4/2003 | Durand et al. | 187/316 |
| 6,943,508 | B2 * | 9/2005 | Morris et al. | 318/38 |

OTHER PUBLICATIONS

International Preliminary Examination Report dated Nov. 14, 2005, relating to International Application No. PCT/US03/36754.

* cited by examiner

*Primary Examiner*—Bentsu Ro
*Assistant Examiner*—Kawing Chan
(74) *Attorney, Agent, or Firm*—Carlson, Gaskey & Olds PC

(57) ABSTRACT

An elevator door mover device (40) includes a threaded ferromagnetic shaft (42). Magnetic movers (48) associated with doors (26) generate magnetic fields that cause the doors to move responsive to rotation of the shaft (42). In one example, a controller (46) controls a speed of a motor (44) that drives the shaft (42). The controller (46) in some examples also selectively controls the strength of the magnetic fields of the movers, which provides more customizable door performance.

20 Claims, 2 Drawing Sheets

MAGNETIC ELEVATOR DOOR MOVER

FIELD OF THE INVENTION

This invention generally relates to elevator door systems. More particularly, this invention relates to an arrangement including a magnetic mover that causes selected movement of an elevator door.

DESCRIPTION OF THE RELATED ART

Elevator systems typically include cars that move between levels within a building to carry cargo or passengers as needed. Typical elevator cars include at least one door that moves between an open and closed position to allow access to the car when it is positioned at an appropriate landing. A variety of door configurations are known.

Typical arrangements include linkage assemblies associated with the top portions of the door to move the doors between the open and closed positions. Typical linkage assemblies, while effective to perform their intended task, are not without drawbacks and shortcomings. Some arrangements are relatively complicated and require more installation time than is desirable. Other arrangements reduce the clearance at the top of the car assembly and introduce an obstacle for an individual performing maintenance who must access the top of the car, for example. Additionally, the relatively long arms and reduction gearing associated with linkage type operators introduce performance limitations on the movement of the doors. Control systems for such arrangements are also complex to compensate for the non-linear relation between motor torque and force supplied to move the doors.

Other proposed solutions have associated shortcomings. This invention provides an improved door moving arrangement that does not suffer from the drawbacks and limitations of prior systems.

SUMMARY OF THE INVENTION

In general terms, this invention is a magnetic-based elevator door moving arrangement.

One device designed according to this invention includes a ferromagnetic shaft that has a threaded exterior. A motor selectively rotates the shaft. At least one magnetic mover is adapted to be supported for movement with an elevator door. The magnetic mover generates a magnetic field that causes the mover and the door to move responsive to rotation of the shaft.

In one example, the magnetic mover includes ferromagnetic members on opposite sides of the shaft. Each ferromagnetic member has a contoured surface facing the shaft and corresponding to the shaft threads. In one example, the contoured surface has the equivalent of threads at a pitch corresponding to the threads on the shaft. A field generator selectively generates the magnetic field such that it passes from the contoured surface on the ferromagnetic members through the corresponding threads on the shaft. The strength of the magnetic field is selectively controlled so that the movers move along the length of the shaft because of the magnetic interaction between the respective parts.

In one example, a controller selectively varies the strength of the magnetic field that causes the movers to follow the threads on the shaft. Controlling the force of the magnetic field allows for selectively controlling the maximum force associated with movement of the door to meet various safety codes regarding encountered obstructions during door closing, for example. Advantageously, this example arrangement effectively decouples the mass of the motor and the shaft from the door, which simplifies the kinetic energy calculations and allows for improved door performance such as faster closing speeds.

In another example, the magnetic mover comprises a permanent magnet situated to follow the threads on the shaft.

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENTS

Figure 1:
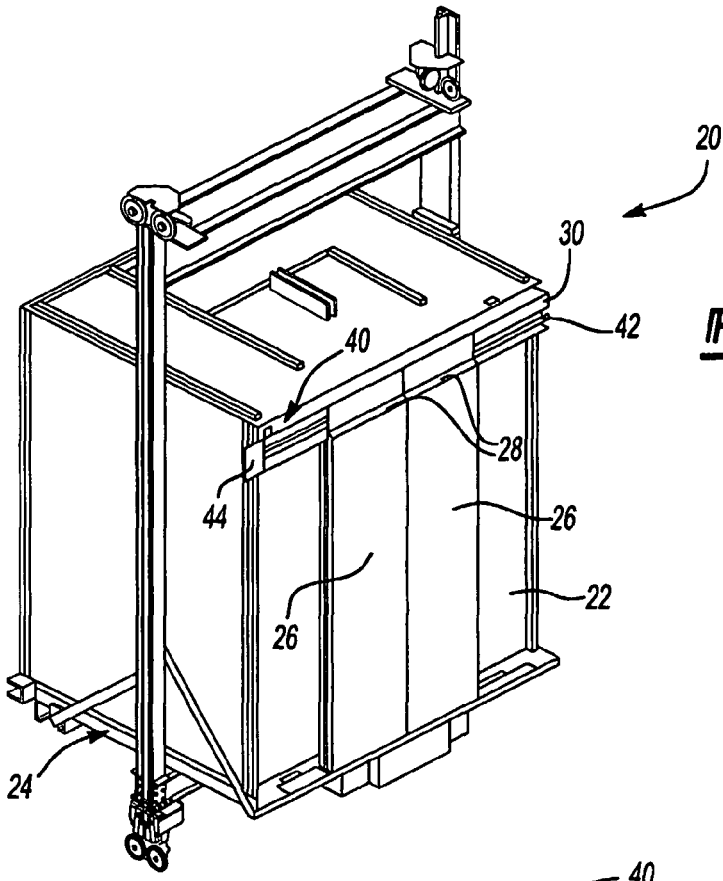
FIG. 1 schematically illustrates an elevator car assembly including a door moving arrangement designed according to this invention.

FIG. 1 schematically shows an elevator car assembly 20 where a cab 22 is supported by a frame 24 in a conventional manner. Doors 26 are supported by conventional hangers 28 that move along a header 30 so that the doors 26 can be moved between open and closed positions to allow selective access to the interior of the cab 22.

Figure 2:
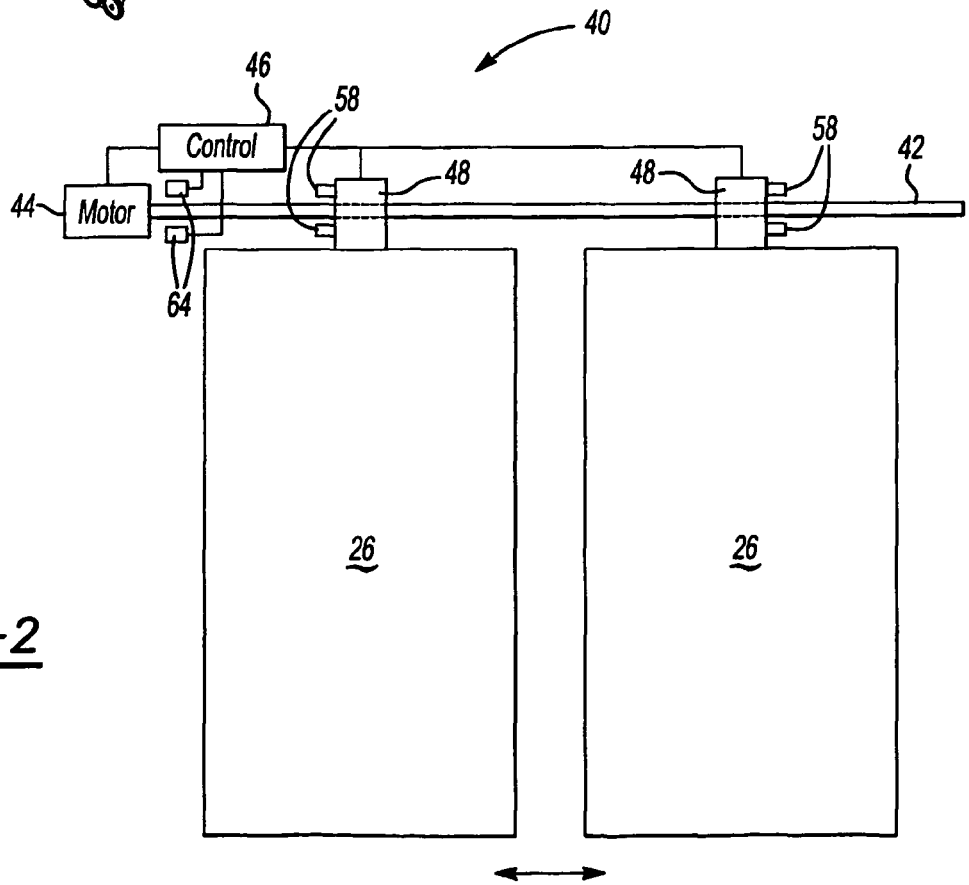
FIG. 2 schematically illustrates an example device for moving elevator doors designed according to an embodiment of this invention.

As best appreciated from FIG. 2, an example device 40 for moving the doors includes an elongated ferromagnetic shaft 42. In the illustrated example, the shaft 42 is threaded. In one example, a course thread pitch similar to an ACME thread is machined into a steel bar to provide the ferromagnetic shaft 42.

A motor 44 selectively rotates the shaft 42. In one example, the motor is an electric motor. Induction motors, DC motors, permanent magnet motors or other known motors may be used. Those skilled in the art who have the benefit of this description will realize which components will best meet the needs of their particular situation.

A controller 46 controls movement of the shaft 42 by controlling operation of the motor 44 in a conventional manner. Magnetic movers 48 are associated with each of the doors 26. At least one magnetic mover 48 is associated with each door. In this example, the controller 46 controls a magnetic field of each of the movers 48 which, in turn, controls movement of the doors 26 and the movers 48 relative to the shaft 42.

Figure 3:
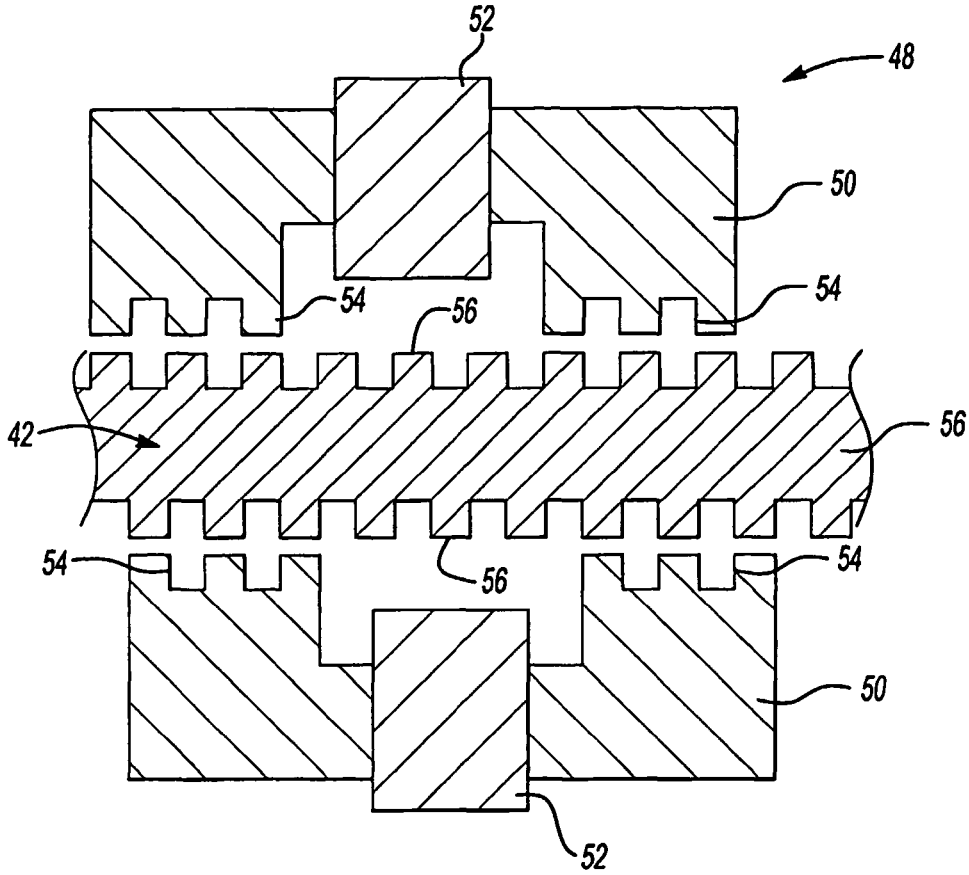
FIG. 3 schematically illustrates, in somewhat more detail, selected portions of the embodiment of FIG. 2.

As can be best appreciated from FIG. 3, an example mover 48 has ferromagnetic members 50 on opposite sides of the shaft 42. A magnetic field generator 52 is supported to move with the ferromagnetic members 50. The surface of the ferromagnetic members 50 facing the shaft 42 include a contour 54 that correspond to the threads 56 on the shaft 42. In this example, the contour 54 is effectively threaded at the same pitch as the threads 56 on the shaft 42. As known, when the threads 54 are aligned with the threads 56, the magnetic flux associated with the magnetic field generated by the field generator 52 more readily passes between the ferromagnetic members 50 and the shaft 42. Accordingly, when the magnetic field has a sufficient strength, as the shaft 42 rotates, the threads 54 follow the threads 56 on the shaft 42 even though there is no physical connection between them. There is no concern with wear when this example embodiment is used because there is no physical contact between the members 50 and the shaft 42. This provides a significant advantage compared to door movers that rely upon physical engagement between moving parts.

In the example shown in FIG. 3, the ferromagnetic members 50 each support a field generator 52 in this example. The field generator 52 responds to the controller 46 to provide a magnetic field of a selected strength having flux lines that extend through the ferromagnetic members 50 and the shaft 42 according to known magnetic principles. Example field generators include magnets and coiled conductors.

Figure 4:
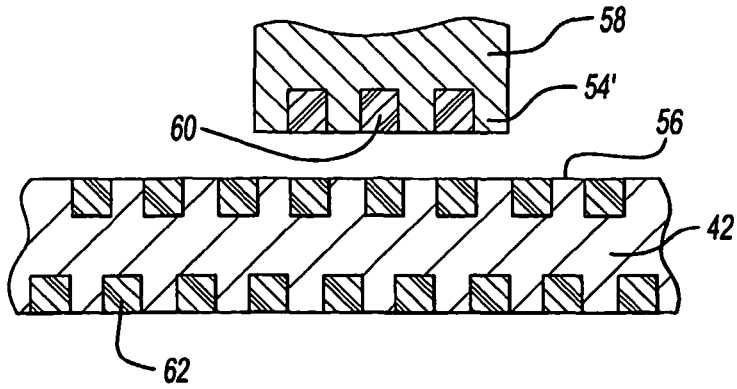
FIG. 4 is a cross-sectional illustration of selected portions of another example embodiment designed according to this invention.

In another example, shown in FIG. 4, the movers 48 comprise permanent magnets 58. A threaded contour 54' provides for interaction between the magnets 58 and the shaft threads 56 to cause desired door movement.

In embodiments having two doors that move in opposite directions, the shaft 42 is threaded in an opposite direction on one half of the shaft compared to the other. This allows for moving both doors 26 at the same time by rotating a single shaft.

One advantage to the example embodiments is that they can accommodate selectively controlling the speed of the motor 44 to control the speed of rotation of the shaft 42 and separately controlling the magnetic fields of the movers 48 so that more customized door movement control is possible. For example, the strength of the magnetic fields of the movers 48 may be set at a level that corresponds to code limitations on the maximum force with which a door can hit a passenger in the doorway while the doors are closing. The inventive arrangements allow for setting the electric field to a value that will be overcome when the impact force exists within code limitations such that the movers 48 will slip relative to the threads 56 on the shaft 42 responsive to the door encountering the passenger or other obstruction.

As shown in FIG. 2, the example embodiment includes proximity sensors 58 that provide information to the controller 46 regarding any slipping between the movers 48 and the shaft 42, which corresponds to relative longitudinal movement between the movers 48 and the shaft 42 that is not responsive to rotation of the shaft. In this example, the proximity sensors 58 comprise known devices such as encoders that provide information to the controller 46 regarding relative slipping and a direction of such movement. In one example, known quadrature techniques are used to provide electrical signals to the controller 46 indicating the direction and amount of any slipping movement. In this example, the sensors 58 move with the door assembly and are calibrated such that the sensors do not provide an output to the controller 46 under normal operating conditions where the threads 54 on the ferromagnetic members 50 are following the threads 56 on the shaft 42. The sensors 58 provide an output when there is relative movement corresponding to slipping or misalignment between the threads 54 and 56, for example.

The controller 46 in one example is programmed to use any slipping information to responsively reduce the strength of the magnetic field of the movers 48, reduce the speed of the motor 44 (i.e., stop rotation of the shaft 42), or both. A significant advantage of the example embodiments is that the mass of the shaft 42 and the motor 44 are effectively decoupled from the doors 26 because of the ability to allow the movers 48 to slip relative to the shaft 42 responsive to encountering an obstruction during closing. This reduction in the effective mass of the door 26 allows for higher speeds of closure while still staying within safety codes, for example.

Another advantageous feature in some embodiments is that the controller 46 can selectively control the speed of the motor 44 and the strength of the magnetic fields of the movers 48 depending on the direction of door movement. For example, moving the doors into an open position can be accomplished using faster shaft speeds and higher magnetic field strengths. Those skilled in the art who have the benefit of this description will realize how to program a controller 46 to meet the needs of their particular situation to achieve the level of performance desired.

FIG. 4 schematically illustrates an example embodiment where a non-ferromagnetic filler 60 fills spaces between the threads 54 on the magnets 58. A corresponding non-ferromagnetic filler 62 fills the spaces between the threads 56 on the shaft 42. In one example, plastic is used as the filler material. The filled spaces between the threads on the magnets 58 and the shaft 42 effectively prevent any contaminants or debris from filling the spaces between the threads, which enhances the reliability of the system operation over longer periods of time. The same filler technique may be used with the example of FIG. 3.

Another feature of the example embodiment in FIG. 2 includes proximity sensors 64 supported relative to the car assembly so that they provide indications to the controller 46 regarding movement of the shaft 42. Based upon information from the sensors 64 and the sensors 58, the controller 46 is programmed to always be aware of the exact door position based upon the sensor indications. Such information allows the controller 46 to appropriately fully open or fully close the doors in situations where the normal movement of the doors was interrupted, for example.

This invention has the advantages of being more compact and more economical than conventional linkage arrangements. This invention also has the advantage of being less complicated than switch reluctance arrangements where the magnetic field in a stator was selectively switched to cause movement of the stator along a stationary shaft. This invention also improves the compliance and performance of the doors.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

I claim:

1. A device (40) for moving elevator doors (26), comprising:

a threaded ferromagnetic shaft (42);

a motor (44) that selectively rotates the shaft; and at least one magnetic mover (48) adapted to be supported for movement with a door (26), the magnetic mover generating a magnetic field that causes the mover to move responsive to rotation of the shaft.

2. The device of claim 1, wherein the magnetic mover (48) comprises ferromagnetic members (50) on opposite sides of the shaft, each ferromagnetic member having a contoured surface (54) facing the shaft and a field generator (52) that selectively generates the magnetic field such that it passes from the contoured surfaces through the corresponding threads (56) on the shaft.

3. The device of claim 2, wherein the field generator (52) comprises at least one of a conductive wire coiled about a portion of the ferromagnetic members or a magnet.

4. The device of claim 2, wherein the contoured surfaces (54) include threads and including a nonmetallic filler (60) in spaces between the threads on the mover ferromagnetic members (50).

5. The device of claim 4, including a nonmetallic filler (62) in spaces between the threads on the shaft (42).

6. The device of claim 1, including a controller (46) that selectively varies a strength of the magnetic field of the mover (48) to thereby control movement of the mover relative to the shaft (42).

7. The device of claim 6, wherein the controller (46) controls the field to move the mover faster in a door opening direction than in a door closing direction.

8. The device of claim 6, wherein the controller (46) uses an indication of longitudinal movement of the mover (48) relative to the shaft (42) not corresponding to rotation of the shaft and responsively controls at least one of the motor or the magnetic field.

9. The device of claim 8, including at least one sensor (58) that provides an indication of slipping between the mover and the shaft to provide the indication of relative longitudinal movement.

10. The device of claim 1, wherein the shaft (42) has a first portion with a thread pitch in one direction and a second portion with a thread pitch in an opposite direction such that movers (48) associated with the first and second portions move in opposite directions responsive to rotation of the shaft.

11. The device of claim 1, including a controller (46) that causes the motor (44) to rotate the shaft (42) faster in a door opening direction than in a door closing direction.

12. The device of claim 1, wherein the mover (48) comprises a permanent magnet (58).

13. An elevator door assembly, comprising:

at least one door (26) that is moveable between an open and a closed position;

a threaded ferromagnetic shaft (42);

a motor (44) that selectively rotates the shaft; and at least one magnetic mover (48) supported for movement with the door, the magnetic mover generating a magnetic field that causes the door to move between the open and closed positions responsive to rotation of the shaft.

14. The assembly of claim 13, wherein the magnetic mover (48) comprises ferromagnetic members (50) on opposite sides of the shaft, each ferromagnetic member having a contoured surface (54) facing the shaft and a field generator (52) that selectively generates the magnetic field such that it passes from the contoured surface (54) through the corresponding threads (56) on the shaft (42).

15. The assembly of claim 13, including a controller (46) that selectively varies a strength of the magnetic field of the mover (48) to thereby control movement of the mover relative to the shaft (42).

16. The assembly of claim 13, including two doors (26) each having at least one associated mover (48) and wherein the shaft (42) has a first portion with a thread pitch in one direction associated with one of the doors and a second portion with a thread pitch in an opposite direction associated with the other door such that the doors move in opposite directions responsive to rotation of the shaft.

17. A method of moving an elevator door (26) that has a magnetic mover (48) associated with the door, the mover interacting with a threaded ferromagnetic shaft (42), comprising the steps of:

selectively rotating the shaft (42); and generating a magnetic field that causes the mover (48) and the door (26) to move longitudinally parallel to the shaft responsive to rotation of the shaft.

18. The method of claim 17, including selectively varying a strength of the magnetic field.

19. The method of claim 17, including increasing a speed of rotation of the shaft (42) and a strength of the magnetic field when the door (26) is moving from a closed position toward an open position.

20. The method of claim 17, including determining whether the mover (48) moves longitudinally relative to the shaft other than responsive to rotation of the shaft (42) and responsively changing one of a speed of rotation of the shaft or a strength of the magnetic field when there is such relative movement.

* * * * *